United States Patent [19]

Siemers

[11] Patent Number: 4,775,547

[45] Date of Patent: Oct. 4, 1988

[54] RF PLASMA METHOD OF FORMING MULTILAYER REINFORCED COMPOSITES

[75] Inventor: Paul A. Siemers, Clifton Park, N.Y.

[73] Assignee: General Electric Company, Schenectady, N.Y.

[21] Appl. No.: 18,554

[22] Filed: Feb. 25, 1987

[51] Int. Cl.[4] ..... B05D 1/08

[52] U.S. Cl. ..... 427/34; 427/423

[58] Field of Search ..... 427/34, 423; 428/608, 428/614, 623, 937

[56] References Cited

U.S. PATENT DOCUMENTS

| | | | |
|---|---|---|---|
| 3,264,508 | 8/1966 | Lai et al. | 313/231.01 |
| 3,575,783 | 4/1971 | Kreider | 427/34 |
| 4,141,802 | 2/1979 | Duparque et al. | 427/34 |

*Primary Examiner*—John H. Newsome

*Attorney, Agent, or Firm*—Paul E. Rochford; James C. Davis, Jr.; James Magee, Jr.

[57] ABSTRACT

The preparation of multilayer filament reinforced consolidated articles is found to be possible because of the unique properties of RF plasma sprayed deposits. Pursuant to this method, a first layer of plasma deposited foil is made with a rough upper surface. A layer of closely spaced aligned reinforcing filaments is positioned on the rough surface. A second foil of RF plasma deposited metal is formed in and on the layer of filaments. A second layer of filaments is positioned on the second foil and a third foil is formed in and on the second layer. The three foils are integrated because of the strong tendency of the RF plasma sprayed metal to penetrate through, wet the fibers, and bond to the layer underneath.

6 Claims, 6 Drawing Sheets

RF PLASMA METHOD OF FORMING MULTILAYER REINFORCED COMPOSITES

RELATED APPLICATIONS

The subject matter of the subject application relates generally to that of copending application Ser. Nos. 010,655, filed Feb. 4, 1987, and 010,882, filed Feb. 4, 1987, and 018,552, filed Feb. 25, 1987. The texts of the copending applications are incorporated herein by reference.

BACKGROUND OF THE INVENTION

The present invention relates to the fabrication of composites of various titanium alloys with high strength filaments. Such composites may include layers of high strength filaments, such as SiC fibers, together with thin layers of titanium in the form of a laminate.

It is known that silicon carbide filaments can be formed with great strength and with high temperature tolerance. It is also known that titanium metal foils have been used in connection with SiC filaments to produce SiC reinforced composites in which the SiC filaments are embedded in a sheet of titanium alloy made up of a number of layers of foil. Such SiC reinforced titanium alloy composites have been identified as potential high strength materials, that is materials which have high strength to weight ratio. Such materials are deemed to be attractive for use in future aircraft engines having high thrust to weight ratios and in wing structures of transatmospheric vehicles. It is anticipated that such titanium alloy matrix composites and laminates will find application in wound rotors and in casings and in other intermediate temperature high stress applications.

Under prior art practice, titanium alloy composites have been fabricated by rolling the desired titanium alloy ingot to about 0.008 to 0.010 inch thick sheet. The sheet is employed as alternate layers in a lay up of titanium alloy sheet and an array of parallel SiC filaments held together with very fine Ti ribbon to form a preconsolidated assembly. The assembly is then consolidated by hot pressing or hot isostatic pressing (HIPing). Extensive filament misalignment has been found to occur in the consolidated composite due to large amounts of metal movement developed during the compaction of the metal about the filaments.

Fabrication of such thin titanium alloy sheets for formation of such a composite can be very costly. This is particularly so if the titanium alloy is not ductile at room temperature. One alloy which lacks such room temperature ductility is niobium modified $Ti_3Al$. This alloy can only be rolled to foils of about 0.020 inch thick. To obtain thinner sheet requires that the thicker sheet be electrochemically machined to the desired thickness. If the final desired thickness is 0.010 inch, then about half of the original material is lost.

Novel and unique structures are formed pursuant to the present invention by plasma spray deposit of titanium base alloys including titanium-aluminum intermetallic compounds employing RF plasma spray apparatus. Filament reinforced structures having a significantly lower measure of damage to the filaments is feasible in these novel and unique structures.

The formation of plasma spray deposits of titanium and of alloys and intermetallic compounds of titanium present a set of processing problems which are unlike those of most other high temperature high strength materials such as the conventional superalloys. A superalloy such as a nickel base or iron base superalloy can be subdivided to relatively small size particles of −400 mesh (about 37 μm) or smaller without causing the powder to accumulate a significant surface deposit of oxygen. A nickel base superalloy in powder form having particle size of less than −400 mesh will typically have from about 200 to about 400 parts per million of oxygen. A powdered titanium alloy by contrast will typically have a ten fold higher concentration of oxygen. A powdered titanium alloy of −400 mesh will have between about 2000 and 4000 ppm of oxygen.

Moreover, titanium alloy powder of less than −400 mesh size is recognized as being potentially pyrophoric and as requiring special handling to avoid pyrophoric behavior.

It is also recognized that the ductility of titanium alloys decreases as the concentration of oxygen and of nitrogen which they contain increases. It is accordingly important to keep the oxygen and nitrogen content of titanium base alloys at a minimum. This can be very difficult for finely divided powders of titanium base alloys.

Prior art plasma spray technology is based primarily on use of direct current plasma guns. It has been recognized that most plasma spray deposits of the superalloys such as nickel and iron base superalloys have had relatively low ductility and that such deposits when in their as-deposited sheet form can be cracked when bent through a sufficiently acute angle due to the low ductility.

I have discovered that RF plasma apparatus is capable of spraying powder of much larger particle size than the conventional DC plasma apparatus. I have discovered that particle sizes at least three times larger in diameter than those conventionally employed in DC plasma spray apparatus may be successfully employed and that the particle size may be as high as 100 μm to 250 μm and larger and as large as 10X as large as the −400 mesh powder previously employed in DC plasma spray practice.

This possibility of employing the larger powder particles is quite important for metal powders such as titanium which are subject to reaction and absorption of gases such as nitrogen and oxygen on their surfaces. One reason is that the surface area of particles relative to their mass decreases inversely as their diameters. Accordingly, a three fold increase in particle diameter translates into a three fold decrease in particle surface area to volume. I have discovered that one result is that RF plasma spray deposited structures of titanium base alloys made with the aid of larger particles have lower oxygen content than might be expected based on knowledge of prior art practices.

As used herein, the term titanium base alloy means an alloy composition in which titanium is at least half of the composition in parts by weight when the various alloy constituents are specified, in parts by weight, as for example in percentage by weight.

A titanium-aluminum intermetallic compound is a titanium-base alloy in which titanium and aluminum are present in a simple numerical atomic ratio and the titanium and aluminum are distributed in the composition in a crystal form which corresponds approximately to the simple numerical ratio such as 3:1 for $Ti_3Al$; 1:1 for TiAl and 1:3 for $TiAl_3$.

$Ti_3Al$ compositions, and particularly Ti-14Al-21Nb, have use temperatures of up to about 1400° F. as compared to the use temperatures of titanium alloys such as Ti-6Al-4V of up to about 1000° F. The use temperatures of TiAl is in the 1700°-1800° F. range.

BRIEF STATEMENT OF THE INVENTION

It is, accordingly, one object of the present invention to provide a novel fabrication technique by which composite structures of titanium base alloys and reinforcing filaments can be formed with a low degree of filaments misaligned during consolidation.

Another object is to provide a method for forming a titanium base metal composite adapted for ready consolidation.

Another object is to provide a composite having a titanium base metal matrix having highly desirable physical properties.

Another object is to provide a method suitable for use in formation of titanium base laminates with silicon carbide or similar reinforcing filaments.

Other objects will be in part apparent and in part pointed out in the description which follows.

In one of its broader aspects, objects of the invention may be achieved by disposing a first array of closely spaced high temperature resistant reinforcing filaments on a substrate surface, providing a powder of a titanium base alloy of average particle size greater than 100 μm, radio frequency plasma spray depositing said powder onto and through said first array of filaments on said substrate surface to form a first layer, having surface irregularities and at least partially enveloping the filaments of said first array, disposing a second array of closely spaced high temperature resistant reinforcing filaments on said first layer, radio frequency plasma spray depositing said powder onto and through said second array of filaments to form a second layer at least partially filling the surface irregularities of said first layer and at least partially enveloping the filaments of said second array.

BRIEF DESCRIPTION OF THE DRAWINGS

The description of the invention which follows will be understood more clearly if in reading the following specification reference is made to the accompanying drawings in which.

DETAILED DESCRIPTION OF THE PRESENT INVENTION

Figure 1:
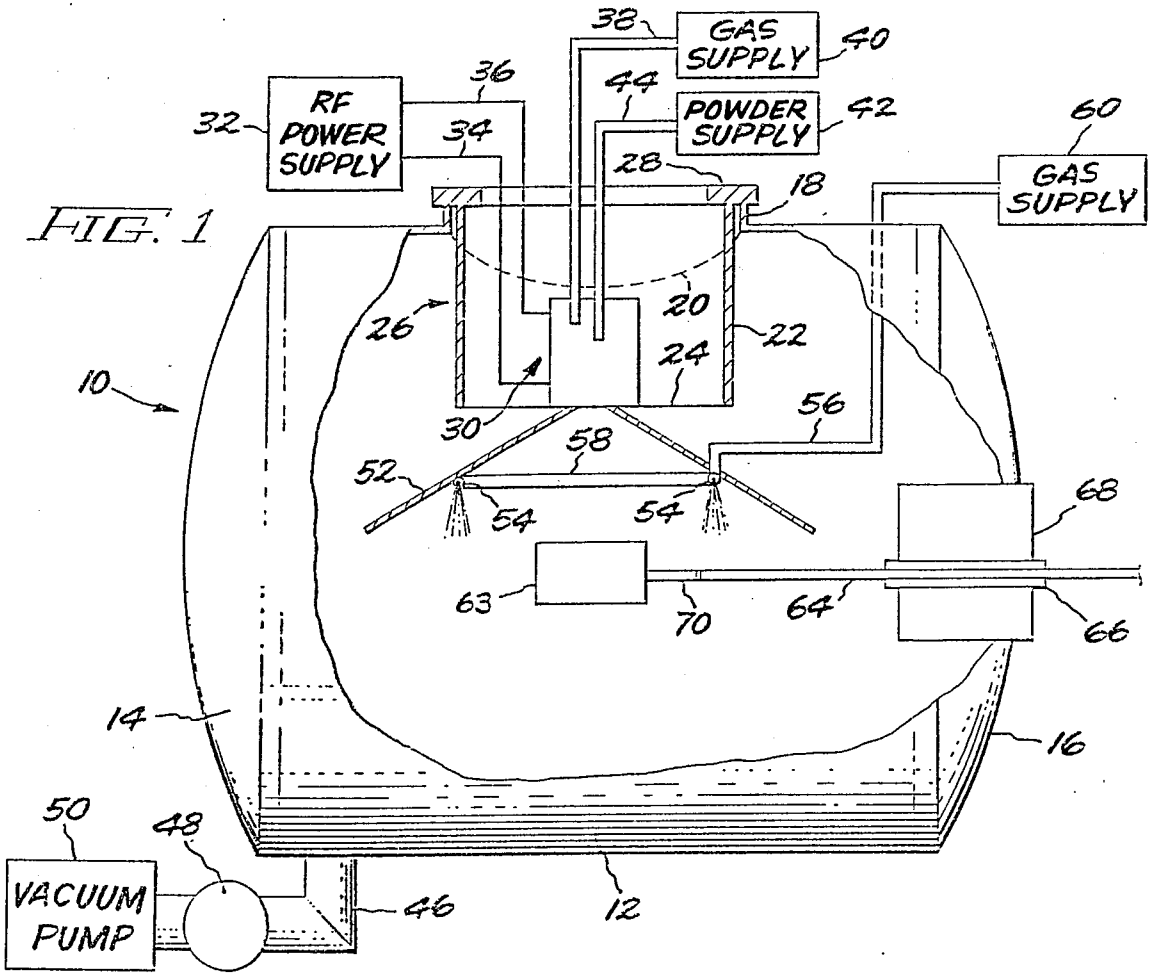
FIG. 1 is a schematic diagram of a system for low pressure RF plasma deposition onto a rotatable platen as a plasma spray receiving surface.

A low pressure radio frequency plasma spray deposit apparatus 10 is made up of a tank 12 having two removable end caps 14 and 16 and the associated apparatus as illustrated in FIG. 1. The tank may have a length of about 5 feet and a diameter of about 5 feet.

At the top of the tank 12 provision is made for introduction of an RF plasma gun into the top of the tank through an opening formed by cutting an opening and welding a collar 18 to the top of tank 12 along seam 20. The RF gun introduced into the tank is positioned within a container in the form of an inverted hat. The hat has sidewalls 22 and bottom wall 24 and has a rim 28 which seats on the collar 18 to provide a hermetic seal by techniques well known in the art.

The gun itself 30 is described in greater detail with reference to FIG. 2. The gun is mounted to the bottom wall 24 of the inverted hat container 26 and is supplied by RF power and also by gas and powder entrained in a carrier gas.

An RF power supply 32 delivers power to the gun 30 over lines 34 and 36. Greater details of its operation are given below with reference to FIG. 2.

Gas is supplied to the interior of gun 30 from gas source 40 through piping 38. Gas supply means 38 is representative of the means for supply of hydrogen gas or helium gas or argon gas or any mixture of gases as may be needed by the commercially available RF plasma gun such as TAFA Model 66 used in connection with the examples below. The specific gases employed depend on the material being plasma sprayed and the specific gases to be used are known in the art. Also, powder entrained in a carrier gas, is supplied to the plasma gun from a powder supply means 42 through piping 44.

A low pressure of 200 to 400 torr is maintained within the tank 12 by means of a pump 50 operating through valve 48 and line 46 connected to the tank 12.

A problem of arc striking against wall interiors from the plasma was studied and was overcome by incorporation of a conical shield 52 extending down from gun 30 and by use of gas jets 54 disposed around the plasma flame from gun 30. Gas is supplied to the jets through the pipe 56 from exterior gas supply means 60. The jets are formed by gas flowing through openings drilled through an annular pipe mounted beneath conical shield 52. The pipe 58 shown in phantom serves as a manifold for the gas as well as providing the bottom drilled openings from which the gas jets 54 emerge.

The object illustrated as that to be coated by plasma spray deposit is a platen 63 held by attachment bolt 70 at the end of an arm 64 extending through one end cap 16 of the tank 12. The arm 64 is hermetically sealed through the end cap 16 by a bushing 66 which is mounted within the box 68. Conventional means are provided in the box 68 for vertical positioning of the bushing 66 before the apparatus is evacuated. The rod may be raised or lowered to permit the position of platen 63 or other sample attached at the end of rod 64 to be adjusted to appropriate positions for the coating process to be performed prior to evacuation of tank 12.

While the plasma spray deposition is in progress, sliding lateral positioning of the platen by inward and outward movement of rod 64 through bushing 66 is also feasible. The platen is subject to rotation by imparting a rotary motion to the external portion of rod 64 by conventional means.

Figure 2:
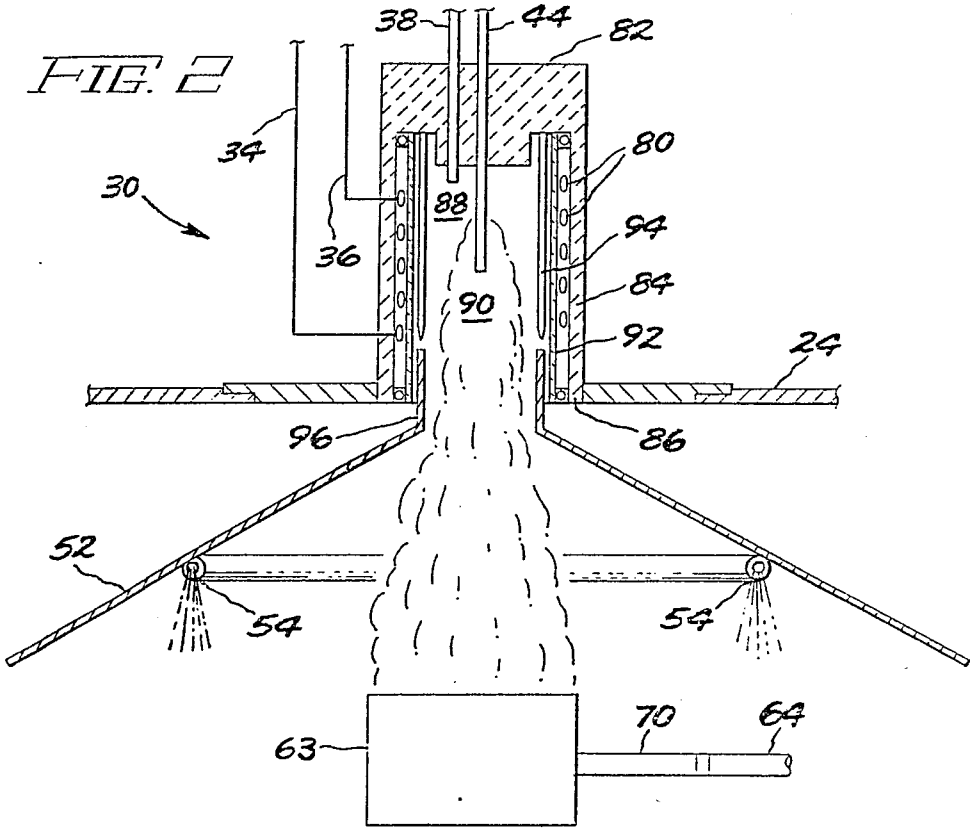
FIG. 2 is a schematic illustration of some details of a low pressure RF plasma gun and deposition apparatus.

Turning now to FIG. 2, a more detailed description of the plasma gun and its operation is provided.

The elements shown in both FIGS. 1 and 2 which bear the same reference numerals are the same articles. It is evident from FIG. 2 that the gun 30 has RF electric supply means 34 and 36 which are the same as those illustrated in FIG. 1. These means are known in the art to be hollow tubes which carry the RF energy and which also carry water to and from the gun for water cooling. Water cooling is necessary because of the high temperatures of 10,000° to 12,000° K. generated within the gun.

Also the gas supply means 38 and powder supply means 44 are provided in supply relationship to the elements of gun 30 as they were in FIG. 1.

The gun 30 is provided with a housing, which includes a closed top wall 82, side walls 84 and a lower opening 86 from which the plasma flame extends.

Powder supply means 44 is a triple wall tube having a hollow innermost center tube for supply of powder and carrier gas. The triple wall is made up of a set of three concentric tubes having a cooling liquid, such as water, flowing in cooling relation in the inner and outer passages between the concentric tubes of powder supply pipe 44.

The gas is injected from means 38 into the top of the chamber 88 within gun 30 and above the zone in chamber 88 where the plasma is formed. The plasma itself is generated by having the radio frequency power impressed on the gas within the chamber 88. A suitable frequency range is from 2 to 5 megahertz and the lower end of this range is preferred.

The RF power is delivered through the lines 34 and 36 to a helical coil built concentric to the sidewalls 84 of the gun 30, individual strands 80 of which are evident in section in FIG. 2. The RF coil made up of strands 80 is separated from the chamber 88 and plasma 90 by a quartz tube 92 mounted as a liner within the gun 30. A water cooled copper liner 94 made up of a ring of water cooled fingers has been found to assist the operation of the gun at higher powers.

The space between gun walls 84 and quartz tube is flooded with water so that the coils are in water, and so that one side of the quartz is directly water cooled.

An exit baffle 96 assists in orienting the flame of the plasma gun 30. The plasma 90 extends from the bottom of the gun downward into heat delivering relation to the platen 63 mounted at the end of rod 64 by a bolt 70.

As explained above, the combination of the stainless steel shield 52 and the gas jets 54 have been successful in preventing an arcing or striking back from the plasma to the walls of the container of the low pressure plasma deposition apparatus 10 as illustrated in FIG. 1.

In operation, a gas or combination of gases is passed through supply means 38 into chamber 88 and the pressure of this gas is kept at a low value of about 250 torr by the action of vacuum pump 50 operating through valve 48 and pipe 46 on the low pressure plasma deposition apparatus including tank 12. The tank itself has a length of about five feet and also a diameter of about five feet. Radio frequency power is impressed on the strands 80 of the coil to excite the gas passing into the housing through tube 38. A plasma 90 is generated within the housing of gun 30. The plasma extends out from the housing and heats the surface of rotating platen 63. The temperature of the plasma is about 10,000° to 12,000° K.

Powder particles, entrained in a carrier gas, are introduced into the plasma through tube 44. The heat of the plasma 90 is sufficiently high to cause a fusion of the particles as they move through the plasma and are then deposited as liquid droplets onto the surface of the platen 63. I have found that the plasma from the RF gun as described above will fuse particles of relatively large diameter of more than 100 μm and will cause them to deposit on a receiving surface from essentially a liquid state.

The vacuum system is operated to maintain a pressure of approximately 250 torr in the low pressure plasma deposition chamber within the container 12. The platen 63 may be rotated within the evacuated chamber as the plasma is used to melt particles into molten droplets to be deposited on the surfaces thereof. Preferably the platen is held stationary and is positioned at right angles to the stream of particles passing through the plasma. The powder feed mechanism 42 is a conventional commercially available device. One particular model used in the practice of this invention was a powder feeder manufactured by Plasmadyne, Inc. of California. It is equipped with a canister on top that holds the powder. A wheel at the bottom of the canister rotates to feed powder into a powder feed hose 44. The powder is then carried by the carrier gas from the powder feeder along the hose 44 to the chamber 88 of gun 30.

A typical run might be carried out under the following conditions:

A power input of 60 Kilowatts
A tank pressure of 250 torr
Gas flow rates for a TAFA Model 66:
- Radial, argon: 117 liters/min.
- Swirl, hydrogen: 5 liters/min.
- Swirl, argon: 16 liters/min.
- cold jet argon: 106 liters/min.

Particle Injection:
- Carrier, helium: 5 liters/min.
- Powder, Ti base alloy: 210–250 μm
- Injection point above nozzle: 7.45 cm.

Deposition Data:
- Target Material: Preformed Steel Foil
- Target size: approx. 4"×5" platen
- Target to Nozzle
- Distance: 11.5"
- Preheating Time: 10 min.
- Deposition Time: 10 min.
- Deposition Rate: 30 grams/min.
- Mass Deposition efficiency: 90–95%

Figure 3:
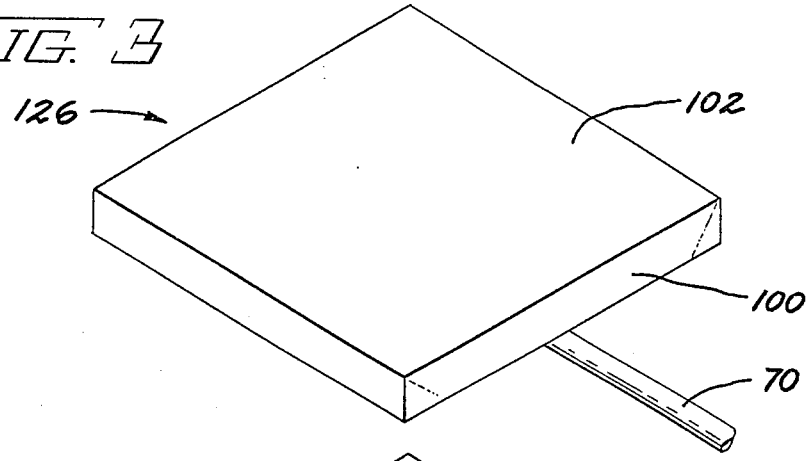
FIG. 3 is a schematic rendering of a planar substrate slab bearing a preformed foil onto which a high density plasma spray deposit of a titanium base alloy has been made.

Referring next to FIG. 3, a platen 126 which serves as a substrate in a low pressure plasma deposition apparatus is illustrated in perspective view.

The platen 126 is supported in the manner illustrated at 63 in FIG. 1 in a position to receive plasma spray deposited titanium metal in a low pressure plasma deposition apparatus as also illustrated in that Figure.

Platen 126 is covered with a preformed foil 100 which is mounted over and around the platen and the ends and edges of which are folded under the back of the platen.

A foil 102 of dense titanium metal is deposited by low pressure RF plasma deposition as explained above on the face of the preformed foil 100 and forms a substrate for further deposits on the foil covered platen 126.

Figure 4:
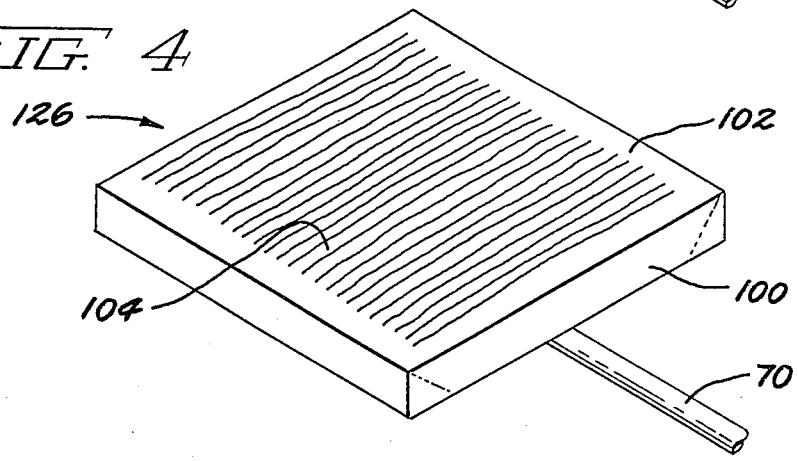
FIG. 4 is a schematic rendering similar to that of FIG. 3 but illustrating an array of high strength high temperature fibers mounted over the central portion of the deposit illustrated in FIG. 3.

Referring next to FIG. 4, a web 104 of closely spaced high strength fibers such as silicon carbide fibers is placed on the plasma formed foil 102 on platen 126. The closely spaced web 104 of fibers may be preformed and may be placed as a preformed unit on the surface of the plasma deposited titanium foil 102. In fact, such webs may be closely spaced at about 130 strands per inch and may be tacked to titanium metal ribbons extending transversely to the fiber strands so that the web may be handled and transferred to a surface such as 102 of FIG. 4.

One such filament was obtained from Avco Company and is known under the trade designation SCS-6. This filament was one of those which was used in the studies leading to this invention. This SCS-6 SiC filament was obtained from Avco as a single filament on a spool of continuous filament.

This type of filament has a 30 μm diameter carbon core on which silicon carbide is coated by chemical vapor deposition. The coating of SiC is 55 μm thick.

Figure 7:
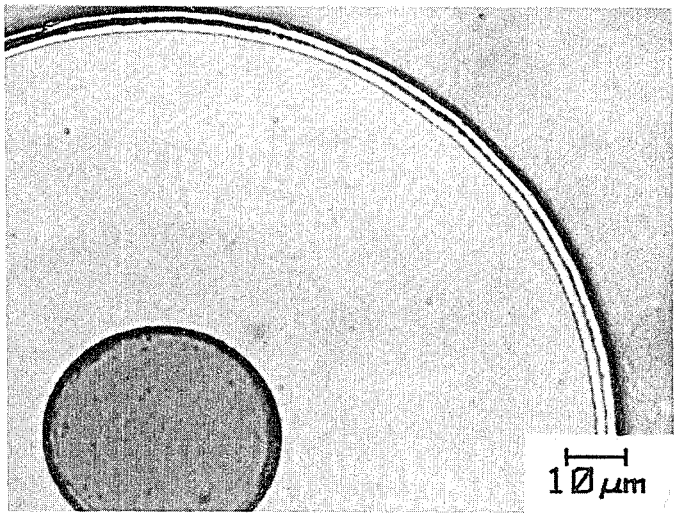
FIG. 7 is a photomicrograph of a section of a single silicon carbide filament.

The outer surface of the SiC coating has two 1.0 to 1.5 μm thick pyrolytic carbon layers to give the filament an overall or total diameter of about 142 μm. A photomicrograph of a section through such a filament is shown in FIG. 7.

A carbon core at the center of the filament serves as a substrate for the deposition of the SiC which is the structural part of the filament. The outer carbon surface layers are intended to minimize interaction between the SiC and the matrix material of the composite.

As part of their quality control, the manufacturer has measured the tensile strength of the filament on the spool as 3150 MPa which is equivalent to 450 ksi. The strength of the filaments was thus somewhat below the values of 3450 and 4140 MPa generally credited to this type of filament.

The manufacturer, Avco Corp., gave a value of the modulus of the SCS-6 filaments as being 500 GPa.

The filaments as described above may be prepared in accordance with the teachings of one or more of the following patents assigned to Avco Corp.: U.S. Pat. Nos. 4,068,637; 4,127,659; 4,481,257; 4,315,968; 4,340,636 and 4,415,609.

A radio frequency plasma gun is commercially available and may be obtained, for example, from TAFA Corp. of California, U.S.A. A TAFA Model 66 may be employed, for example.

The composite formed as described above, is employed as a substrate for the mounting of an additional web or webs of high strength high temperature fibers and the plasma deposit of an additional layer or layers of titanium base alloy to build up the composite structure into a multilayer structure of alternate layers of fibers and spray deposited titanium base metal.

Figure 5:
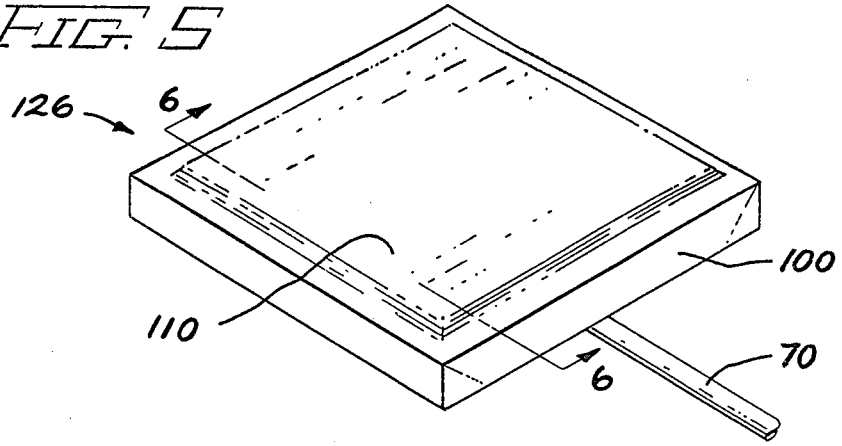
FIG. 5 is a schematic rendering similar to that of FIG. 4 but illustrating the result of plasma spray depositing a titanium base alloy into and onto the array of high strength high temperature fibers mounted according to FIG. 4.

Referring next to FIG. 5, a pre-compaction sealed composite structure is illustrated which is made up of at least two outer plasma deposited layers and which have between the layers at least two webs of high temperature high strength reinforcing filaments. Top layer 110 is visible in the Figure. The filaments are at least partially enveloped by the uppermost layer of plasma spray deposited titanium base alloy.

Figure 6:
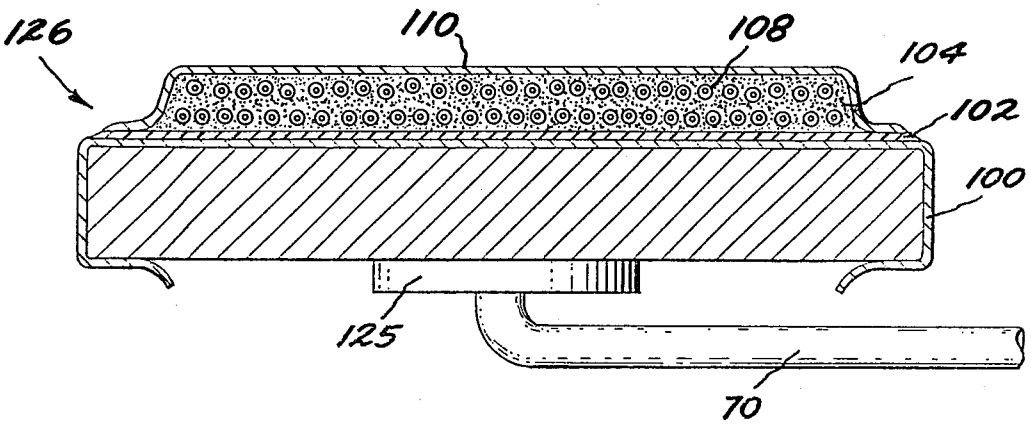
FIG. 6 is a schematic sectional view of a composite structure as prepared pursuant to the present invention taken along the line 6—6 of FIG. 5.

The enveloping of the fibers in the plasma-deposited titanium base alloy is more evident from the illustration of FIG. 6. FIG. 6 is a cross-sectional view of the structure of FIG. 5 but taken along line 6—6 of FIG. 5.

Referring next to FIG. 6, platen 126 is schematically illustrated as supported by flange 125 mounted to platen 126. Flange 125 is held by support rod 70, attached in turn to rod 64 which is attached in turn to indexing means outside the low pressure plasma deposition apparatus and not illustrated in the Figure.

Platen 126 has a pre-formed foil 100 mounted about and folded under and against the back of the platen. A first plasma deposited titanium base alloy layer 102 is shown as formed and deposited on the preformed foil 100. Such layer may have the irregular surface characteristics of such plasma formed deposits as illustrated in FIG. 7. Overlaying the titanium alloy layer 102 is a first filament layer 104 of high temperature high strength filaments enmeshed in plasma deposited titanium alloy. A photomicrograph of a section of a high strength silicon carbide filament as described above is presented in FIG. 7.

The layer 104 is enclosed within a plasma deposited overlaying layer of titanium base alloy 106. The layer 106 has a rough upper surface just as the original plasma deposited layer had a rough upper surface. On this rough surface a second filament layer 108 is deposited. Following deposit of the filament layer 108 the structure is again introduced into the low pressure RF plasma deposition apparatus and a third layer of titanium base alloy is deposited so as to bury the second layer of filaments.

Layers 102 and 110 are illustrated in the Figure as separated foil like layers for the sake of clarity of illustration. However, these layers may blend with the metal laden filament containing layers 104 and 108 so that no clear demarcation of layers as shown exists in an actual product.

In fact one of the features of the present invention is that it has been found to be possible to form a good bond between upper and lower RF plasma deposited layers of titanium base alloys even though the upper layer is formed with a web or mat of filaments overlaying the lower layer at the time of forming the upper layer.

While the building of a multilayer composite structure of filament reinforced titanium base alloy may be carried out on a flat platen as described above, it is preferred for some operations to build such a multilayer structure on a drum.

EXAMPLE 1

One such structure which was built on a drum is described here. The drum used was a four inch wide by seven inch diameter drum mounted to a bolt. It was used in the apparatus as described in FIGS. 1 and 2 in place of platen 63.

Figure 8:
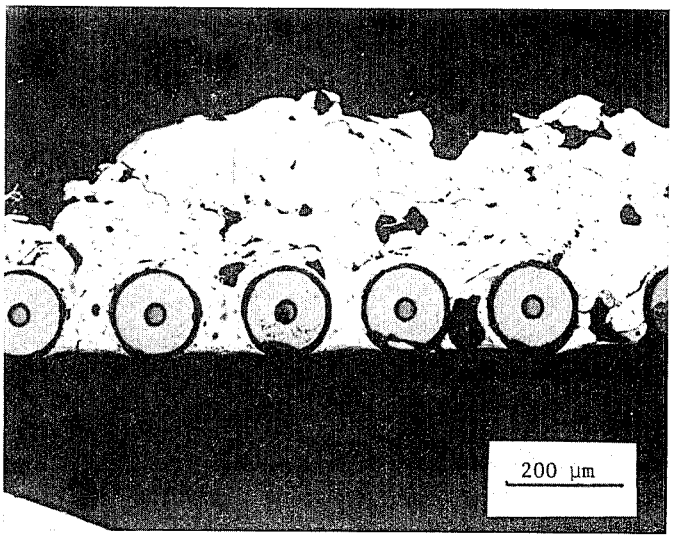
FIG. 8 is a photomicrograph of a section of a plasma formed foil of a titanium base alloy incorporating an array of filaments therein and illustrating the degree of irregularity of the surface of the plasma spray deposited layer.

The drum was first coated with a preformed metal foil large enough to be wrapped completely around the 7 inch diameter drum and to be folded over the edges of the drum. The foil wrapped drum was then wound with filament as described above with 132 filaments per inch being wound on the foil. This structure was then RF plasma sprayed with large particles of titanium base alloy of over 100 μm to coat on and between the filaments and to form a filament impregnated layer of titanium base alloy. This first layer did penetrate between the filaments to at least partially envelop the filaments and it did have a rough outer surface as has been found characteristic of such RF plasma spray deposited titanium base alloy layers. A first layer of a RF plasma sprayed titanium base alloy in which a web of reinforcing filaments are embedded and which has a rough upper surface is illustrated in FIG. 8. Observation of the photomicrograph of this figure will reveal that the individual filaments are of the form shown in FIG. 6.

Following RF plasma deposition of the first titanium base metal alloy the drum was removed from the plasma spray apparatus. The central portion of the coated surface of the drum was wound with a web of filaments at a spacing of 132 per inch.

The drum was again introduced into the plasma spray apparatus as illustrated in FIGS. 1 and 2 and attached by its integral bolt to the end of rod 64 for rotation beneath the plasma gun 30.

The external surface of the drum was then RF plasma sprayed with particles of over 100 μm average particle size of a titanium base alloy and specifically, Ti-6Al-2Sn-4Zr-2Mo, a composition in parts by weight containing 6 parts aluminum, 2 parts tin, 4 parts zirconium, 2 parts molybdenum and the balance titanium. The spraying was done to deposit a second layer of filament reinforced titanium base alloy on the drum.

Following deposition of the second titanium layer the two layer deposit was removed from the wheel, separated from the preformed foil and sectioned for study. A photomicrograph of a section through the two layer deposit was made and is presented as FIG. 9.

Figure 9:
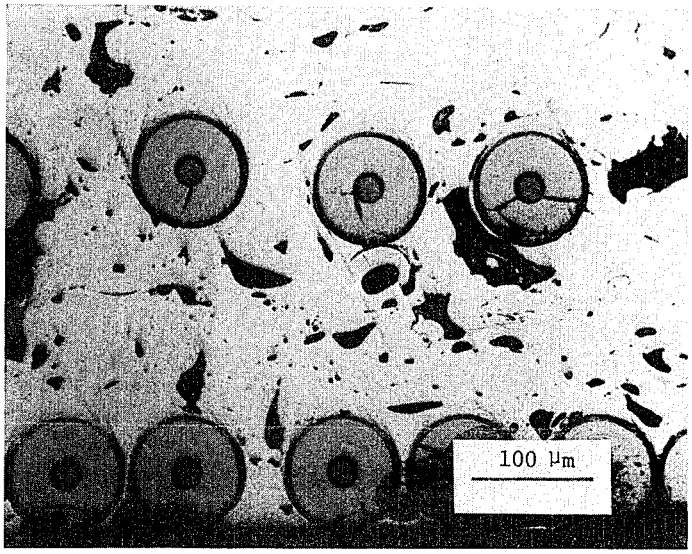
FIG. 9 is a photomicrograph of an array of silicon carbide filaments in an as-sprayed titanium base metal matrix.

The photomicrograph of FIG. 9 was prepared of the cross-section of the resulting compact to show the array of reinforcing filaments and the way in which they were embedded in the RF plasma spray deposited Ti-6Al-2Sn-4Zr-2Mo. The emphasis of the micrograph of FIG. 9 is to show the penetration of the titanium-6242 metal through filaments which are reasonably well spaced as well as the degree of the filling in the crevices and other irregularities of the rough surface at the top of the first plasma formed foil.

As is evident from the photomicrograph of FIG. 9, the second layer or mat of filaments was supported above the rough surface of the first deposited foil.

However, there is little evidence remaining in FIG. 9 of the rough surface on which the second layer of filaments were supported when the second foil of RF plasma deposited titanium base metal was formed. This is because pursuant to the present invention, the RF plasma spray deposit penetrates through and between the filaments to at least partially fill the crevices and depressions in the rough surface of the lower layer of foil.

After the two metal layers, specifically the first and second layers have been formed by plasma spray deposition of the metal, the compact has a relatively low level of porosity. This low level is achieved because the plasma spray deposition process of this invention delivers relatively liquid metal droplets to the structure. These droplets are able to penetrate through the layer of spaced reinforcing filaments and are able to wet the metal of the foil beneath the layer of filaments. Thus, although the upper surface of each foil is rough when formed as is evident in part from FIG. 8, because of the ability of the RF plasma to deliver high temperature liquid, the droplets of metal penetrate through the array of reinforcing filaments and at least partially fill in most of the crevices of the rough surface beneath the filamentary layer.

In addition, the hot liquid metal droplets surround the individual filament strands and form an effective solid metal envelope extending beneath, around and above the filaments. Some porosity remains, but the level of porosity of the as-deposited metal is relatively low in comparison to the structure which would be formed if an attempt were made to construct an equivalent compact using direct current plasma spray technology and the more finely divided metal powder which must be employed in such d.c. plasma spray deposit technique.

The comparatively lower level of porosity of the two as-deposited filament reinforced layers of a compact prepared as described above is illustrated in the photomicrograph of FIG. 9. The photomicrograph is taken through a section of a RF plasma formed titanium base metal structure having multiple layers of reinforcing filaments which was prepared essentially as described above. One difference is that the original layer used in forming the compact was not a rough surfaced RF plasma deposited foil but was rather a smooth surfaced pre-formed foil of another metal.

For the structure shown in FIG. 9 the first layer to be placed on the pre-formed foil was a layer of aligned filaments. These filaments are silicon carbide filaments prepared as described above and as illustrated in the micrograph of FIG. 7. Also after deposition of the first titanium base metal layer with its rough upper surface a second mat of filaments is disposed by winding filament over the rough surface of the first metal deposit.

Also, the droplets of molten metal which are forming the second layer are able to effectively adhere to and bond to the upper surface of the lower layer to effectively eliminate the appearance of separate layers. Moreover, the liquid droplets of RF plasma deposited metal effectively wet and flow around the reinforcing filaments so that individual filaments become completely surrounded with metal at at least one portion of their length and are thus at least partially embedded in the titanium base metal. This phenomena of having the titanium base metal effectively form an envelope around portions of the reinforcing filaments is evident from the configuration of titanium base metal in relation to the upper layer of filaments of FIG. 9.

One distinct advantage of the configuration of matrix metal in relation to the reinforcing filaments as illustrated in FIG. 9 is that only minor movement of metal is needed during consolidation of the structure into a fully dense article. The voids in the titanium matrix metal of the deposit of FIG. 9 are seen to be of a relatively low order in relation to the bulk of the matrix titanium base metal. Consolidation of the compact as illustrated in FIG. 9 by conventional techniques such as HIPing in high temperature, high pressure fluids leads to elimination of the voids such as may be seen in FIG. 9. The minor movement of metal needed for consolidation also results in a minor movement of the filaments. Such minor movements of the reinforcing filaments is highly favorable to maintenance of filament alignment during consolidation.

Also, there may be less abrasion of the surface of the filaments when the filament is essentially enveloped in the matrix metal before the consolidation starts than there is, for example, when the composite is formed from a multilayer sandwich of filament mats and preformed foils in which the foils and filament mats alternate in the sandwich. Consolidation of foils result in a movement of metal of the foil against and across the filament surfaces as the metal changes from its original foil configuration to its final matrix configuration. Some damage to the filament surfaces may result.

Any such damage is decreased pursuant to the present invention because the degree of movement of the metal is decreased and the metal has a high degree of contact with the filament surfaces at the outset as is evident from the relation of metal to filament illustrated in FIG. 9.

What is claimed is:

1. The method of forming a high strength fiber reinforced titanium base alloy composite which comprises providing said titanium base alloy in powdered form with particle sizes greater than 100 μm, radio frequency plasma spray depositing said powder onto a receiving surface to form a first high density layer of said titanium base alloy, disposing a mat of filament reinforcement on said high density layer, radio frequency plasma spray depositing said powder into and onto said fiber reinforcement foil to form a second high density layer bonded to said first high density layer as a composite, disposing at least one more additional mat of filament reinforcement on said second high density layer, radio frequency plasma spray depositing said powder into and onto said additional fiber reinforcement to form a third high density layer bonded to said second high density layer, and heating and isostatically pressing the composite to compress the contents thereof to high density.

2. The method of claim 1 in which the fiber reinforcement is silicon carbide fibers.

3. The method of claim 1 in which the titanium base alloy is Ti-6Al-4V.

4. The method of claim 1 in which the titanium base alloy is Ti-6Al-2Sn-4Zr-2Mo.

5. The method of claim 1 in which the titanium base alloy is $Ti_3Al$.

6. The method of claim 1 in which the titanium base alloy is TiAl.

* * * * *